US012458204B2

(12) United States Patent
Dunaway et al.

(10) Patent No.: US 12,458,204 B2
(45) Date of Patent: Nov. 4, 2025

(54) LOCATING CLIP FOR A BOTTLE WASHER ASSEMBLY OF A DISHWASHER APPLIANCE

(71) Applicant: Haier US Appliance Solutions, Inc., Wilmington, DE (US)

(72) Inventors: Logan Chayse Dunaway, Greenville, IN (US); Aldo Vincent Kremmel, Palmyra, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 119 days.

(21) Appl. No.: 18/422,725

(22) Filed: Jan. 25, 2024

(65) Prior Publication Data

US 2025/0241509 A1 Jul. 31, 2025

(51) Int. Cl.

| | |
|---|---|
| ***A47L 15/50*** | (2006.01) |
| ***A47L 15/00*** | (2006.01) |
| ***A47L 15/42*** | (2006.01) |

(52) U.S. Cl.

CPC ..... *A47L 15/505* (2013.01); *A47L 15/0065* (2013.01); *A47L 15/4278* (2013.01)

(58) Field of Classification Search

CPC . A47L 15/505; A47L 15/0065; A47L 15/4278
See application file for complete search history.

(56) References Cited

U.S. PATENT DOCUMENTS

| | | | | |
|---|---|---|---|---|
| 5,918,749 | A * | 7/1999 | Pille | A47L 15/505 211/41.9 |
| 6,827,225 | B2 * | 12/2004 | Miilu | A47L 15/505 211/41.9 |
| 7,543,712 | B2 | 6/2009 | Purushothaman | |
| 9,675,232 | B2 | 6/2017 | Ross et al. | |
| 10,111,576 | B2 * | 10/2018 | Boyer | A47L 15/508 |
| 2016/0302643 | A1 * | 10/2016 | Mersch | A47L 15/4278 |

FOREIGN PATENT DOCUMENTS

| | | |
|---|---|---|
| EP | 3451892 B1 | 11/2019 |
| EP | 3791770 B1 | 7/2023 |

* cited by examiner

*Primary Examiner* — Michael E Barr
(74) *Attorney, Agent, or Firm* — Dority & Manning, P.A.

(57) ABSTRACT

A bottle washer assembly for a dishwasher appliance may include a main conduit. The main conduit may define a main passage for flowing wash fluid therethrough. The bottle washer assembly may also include a bottle jet. The bottle jet may include a spray conduit extending between a proximal end and a distal end. The spray conduit may define a passage in selective fluid communication with the main passage. The spray conduit may also include a spline portion positioned at the proximal end. The spline portion may include one or more teeth extended therefrom. The bottle washer assembly may further include a clip. The clip may define one or more grooves for receiving the one or more teeth.

20 Claims, 6 Drawing Sheets

LOCATING CLIP FOR A BOTTLE WASHER ASSEMBLY OF A DISHWASHER APPLIANCE

FIELD OF THE DISCLOSURE

The present subject matter relates generally to a dishwasher appliance, and more particularly to a bottle washer assembly of a dishwasher appliance.

BACKGROUND OF THE DISCLOSURE

Dishwasher appliances generally include a tub that defines a wash chamber therein. Various spray assemblies may be disposed within the wash chamber. During operation of the dishwasher appliances, the spray assemblies direct wash fluid towards articles within rack assemblies in the wash chamber. Thus, the spray assemblies provide multiple outlets for directing wash fluid onto articles within the rack assemblies during operation of the dishwasher appliances.

In certain dishwasher appliances, a bottle washer assembly is provided as one of the spray assemblies. Suitable articles, such as bottles, cups, glasses, etc., are provided on the bottle washer assembly such that, for example, an article generally surrounds a spray tine. Wash fluid is ejected from the spray tine to clean the inside of the article. However, challenges currently exist with bottle washer assemblies. For example, during a wash cycle, articles provided on the bottle washer assembly can collide if they are not placed properly. As another example, the orientation of one or more components of the bottle washer assembly can make loading and unloading of articles into and out of the rack assembly difficult. As yet another example, a user can mishandle the bottle washer assembly and unintentionally remove one or more components of the bottle washer assembly.

Accordingly, a bottle washer assembly that obviates one or more of the above-mentioned drawbacks would be useful.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a bottle washer assembly for a dishwasher appliance is provided. The bottle washer assembly may include a main conduit. The main conduit may define a main passage for flowing wash fluid therethrough. The bottle washer assembly may also include a bottle jet. The bottle jet may include a spray conduit extending between a proximal end and a distal end. The spray conduit may define a passage in selective fluid communication with the main passage. The spray conduit may include a spline portion positioned at the proximal end. The spline portion may include one or more teeth extended therefrom. The bottle washer assembly may further include a clip defining one or more grooves for receiving the one or more teeth.

In another exemplary aspect of the present disclosure, a dishwasher appliance is provided. The dishwasher appliance may include a tub. The tub may define a wash chamber. The dishwasher appliance may further include a rack assembly disposed within the wash chamber of the tub. The dishwasher appliance may also include a first spray assembly positioned adjacent the rack assembly. The dishwasher appliance may further include a second spray assembly positioned adjacent the rack assembly. The second spray assembly may be a bottle washer assembly. The bottle washer assembly may include a main conduit. The main conduit may define a main passage for flowing wash fluid therethrough. The bottle washer assembly may further include a bottle jet. The bottle jet may include a spray conduit extending between a proximal end and a distal end. The spray conduit may define a passage in selective fluid communication with the main passage. The spray conduit may include a spline portion positioned at the proximal end. The spline portion may include one or more teeth extended therefrom. The bottle washer assembly may further include a clip. The clip may define one or more grooves for receiving the one or more teeth.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
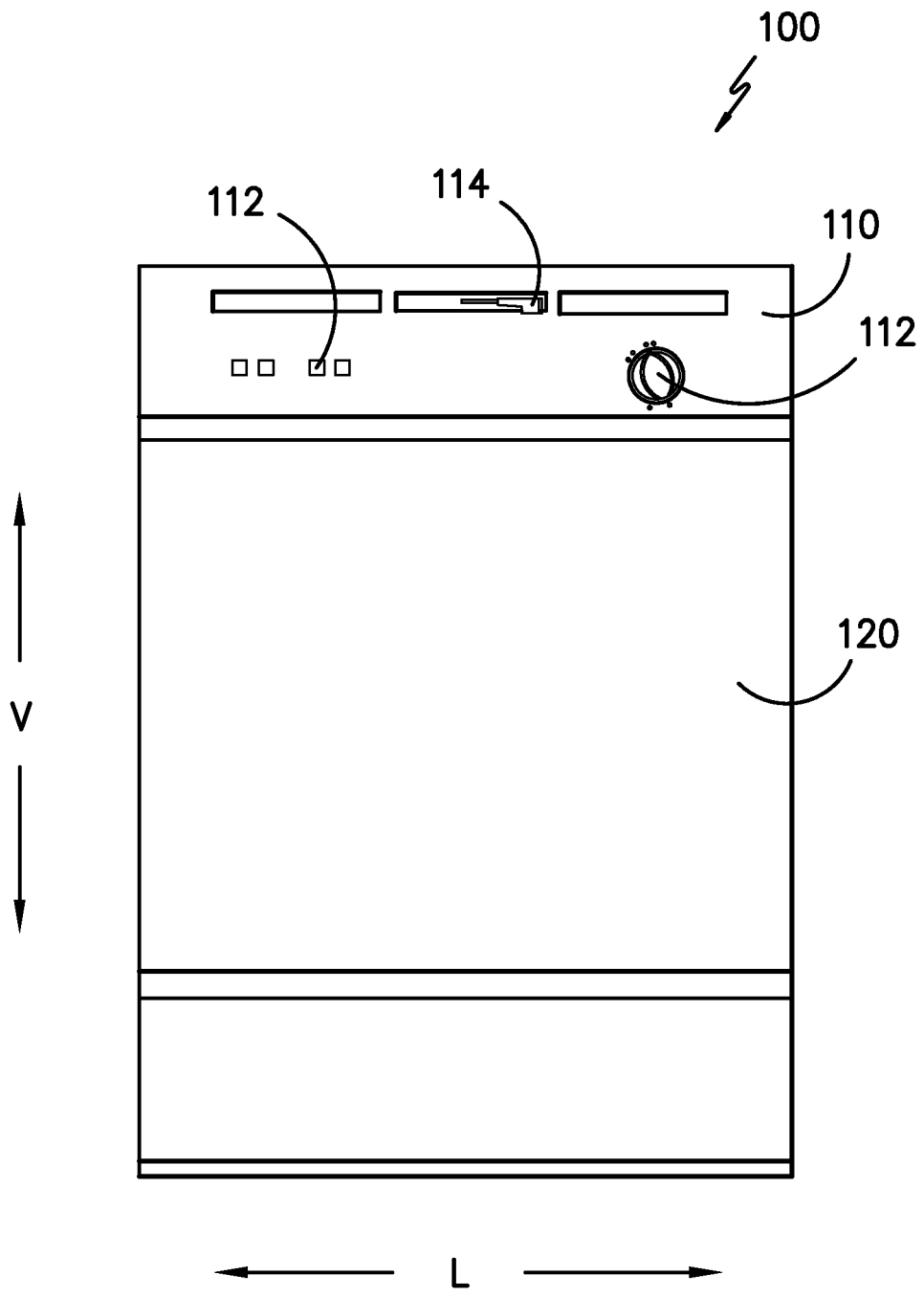
FIG. 1 provides a front elevation view of a dishwasher appliance according to one or more exemplary aspects of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and the like may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Exemplary aspects of the present subject matter advantageously provide a bottle washer assembly including one or more selectively rotatable spline joints. The exemplary selectively rotatable spline joints advantageously allow a user to rotate a clip relative to a spray conduit of a bottle jet between one or more predetermined positions. In each predetermined position the clip may be selectively locked in place relative to the spray conduit. In this regard, a predetermined rotational force may be required to transition the clip from one predetermined position to another. Thus, the selectively rotatable spline joint may advantageously prevent or mitigate unwanted movement of the clip and prevent or mitigate collision of articles provided on the bottle washer assembly.

Figure 2:
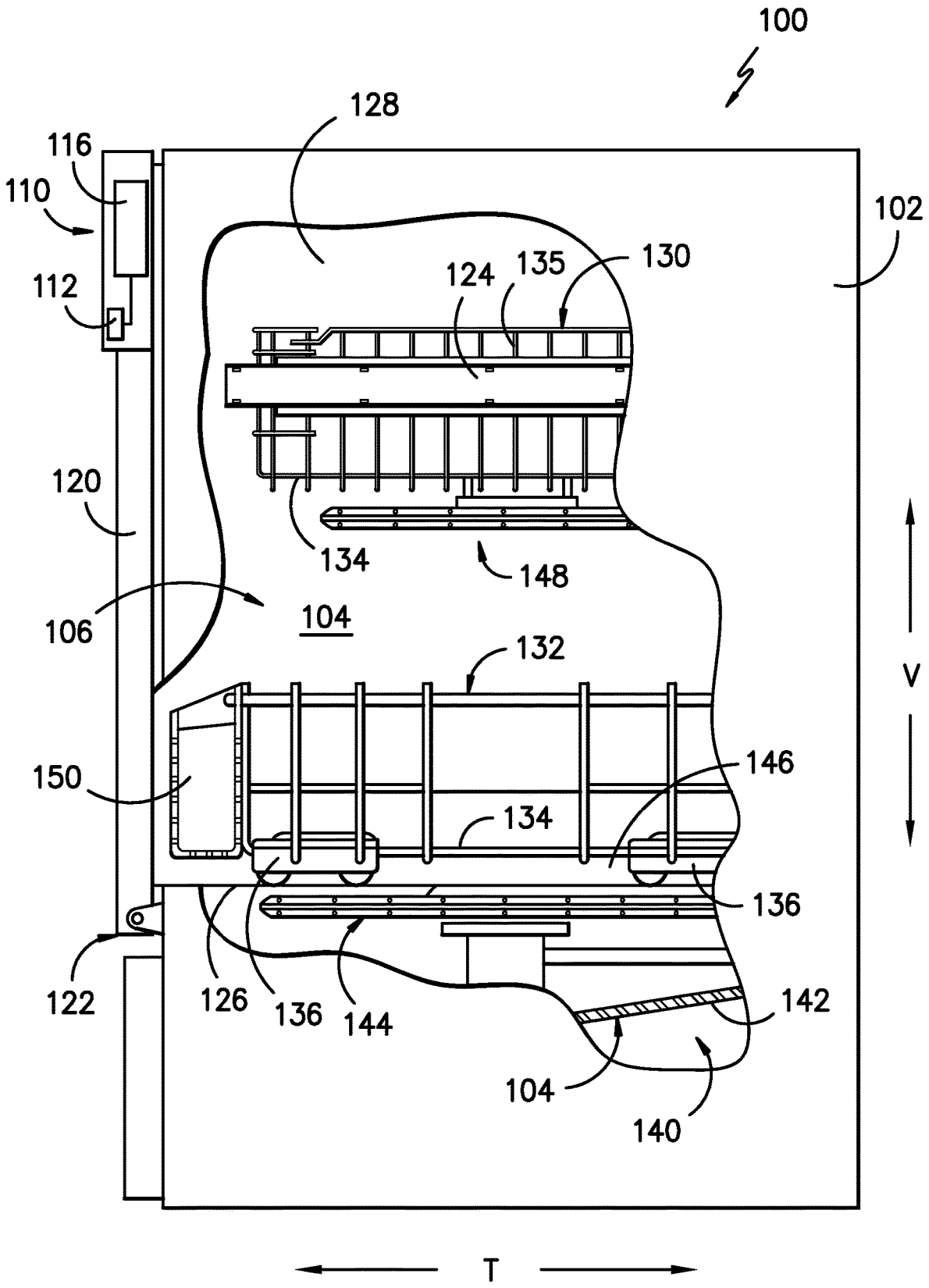
FIG. 2 provides a partial side section view of a dishwasher appliance according to one or more exemplary aspects of the present subject matter.

FIGS. 1 and 2 depict a dishwasher appliance 100 according to an exemplary embodiment of the present subject matter. Dishwasher appliance 100 defines a vertical direction V, a lateral direction L and a transverse direction T. The vertical direction V, the lateral L, and transverse direction T are mutually perpendicular and form an orthogonal direction system.

Dishwasher appliance 100 may include a chassis or cabinet 102 having a tub 104. The tub 104 may define a wash chamber 106. The tub may include a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. In some embodiments, a latch 114 is used to lock and unlock door 120 for access to chamber 106.

Slide assemblies 124 may be mounted on opposing tub sidewalls 128 to support and provide for movement of an upper rack assembly 130. Lower guides 126 may be positioned in opposing manner of the sides of chamber 106 and may provide a ridge or shelf for roller assemblies 136 so as to support and provide for movement of a lower rack assembly 132. Each of the upper and lower rack assemblies 130 and 132 may be fabricated into lattice structures including a plurality of elongated members 134 and 135 that extend in lateral direction L, the transverse direction T, or the vertical direction V. Each rack assembly 130, 132 may be adapted for movement between an extended loading position (not shown) in which the rack is substantially positioned outside the wash chamber 106, and a retracted position (shown in FIGS. 1 and 2) in which the rack is located inside the wash chamber 106. This may be facilitated by slide assemblies 124 and roller assemblies 136 that carry the upper and lower rack assemblies 130 and 132, respectively. A silverware basket 150 may be removably attached to the lower rack assembly 132 for placement of silverware, small utensils, and the like, that are too small to be accommodated by the upper and lower rack assemblies 130, 132.

Dishwasher appliance 100 may also include a lower spray assembly 144 that may be rotatably mounted within a lower region 146 of the wash chamber 106 and above a tub sump portion 142 so as to rotate in relatively close proximity to lower rack assembly 132. A spray arm or mid-level spray assembly 148 may be located in an upper region of the wash chamber 106 and may be located in close proximity to upper rack assembly 130. Additionally, an upper spray assembly (not shown) may be located above the upper rack assembly 130 and mounted to an upper wall of tub 104.

Lower and mid-level spray assemblies 144, 148 and the upper spray assembly may be fed by a fluid circulation assembly for circulating water and wash fluid in the tub 104. Portions of the fluid circulation assembly may be located in a machinery compartment 140 located below tub sump portion 142 of tub 104, as generally recognized in the art. Each spray assembly includes an arrangement of discharge ports or orifices for directing washing liquid onto dishes or other articles located in upper and lower rack assemblies 130, 132, respectively. The arrangement of the discharge ports in at least the lower spray assembly 144 may provide a rotational force by virtue of washing fluid flowing through the discharge ports. The resultant rotation of lower spray assembly 144 may provide coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 116 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the present subject matter is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower rack assemblies 130, 132 or lower and mid-level spray assemblies 144, 148, and other differences may be applied as well.

Figure 3:
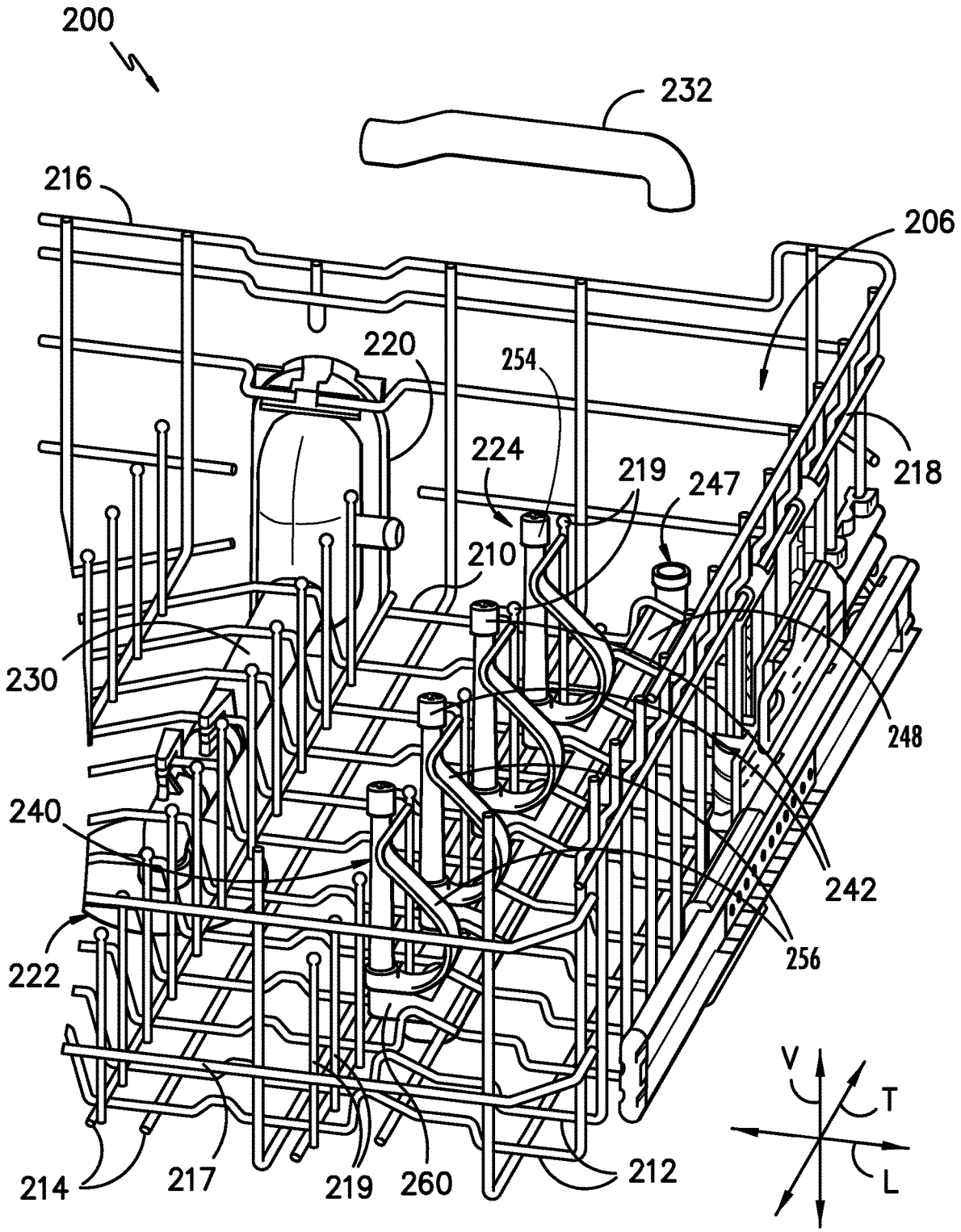
FIG. 3 provides a partial perspective view of a rack assembly according to one or more exemplary aspects of the present subject matter.
Figure 4:
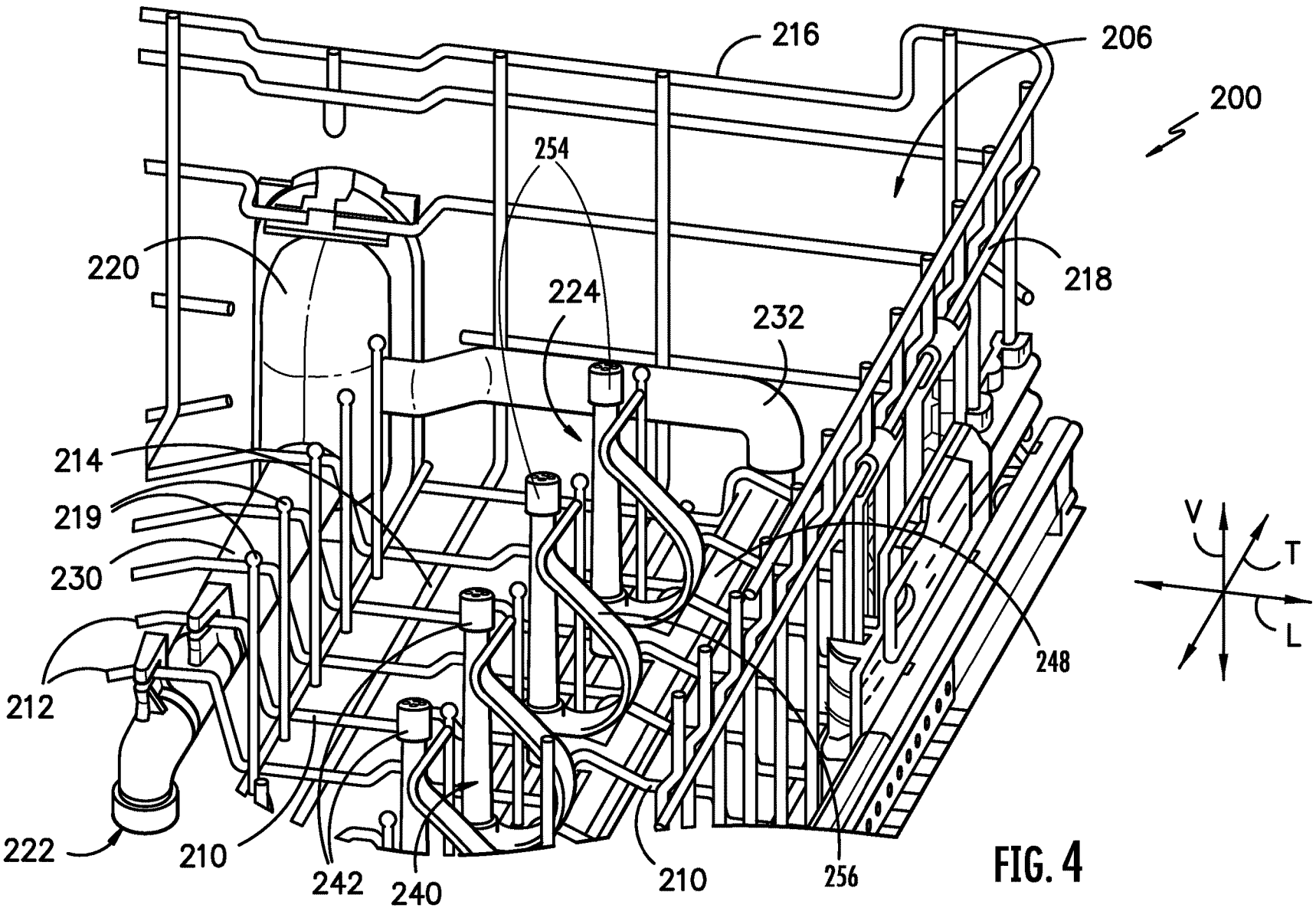
FIG. 4 provides a partial perspective view of a rack assembly according to one or more exemplary aspects of the present subject matter.
Figure 5:
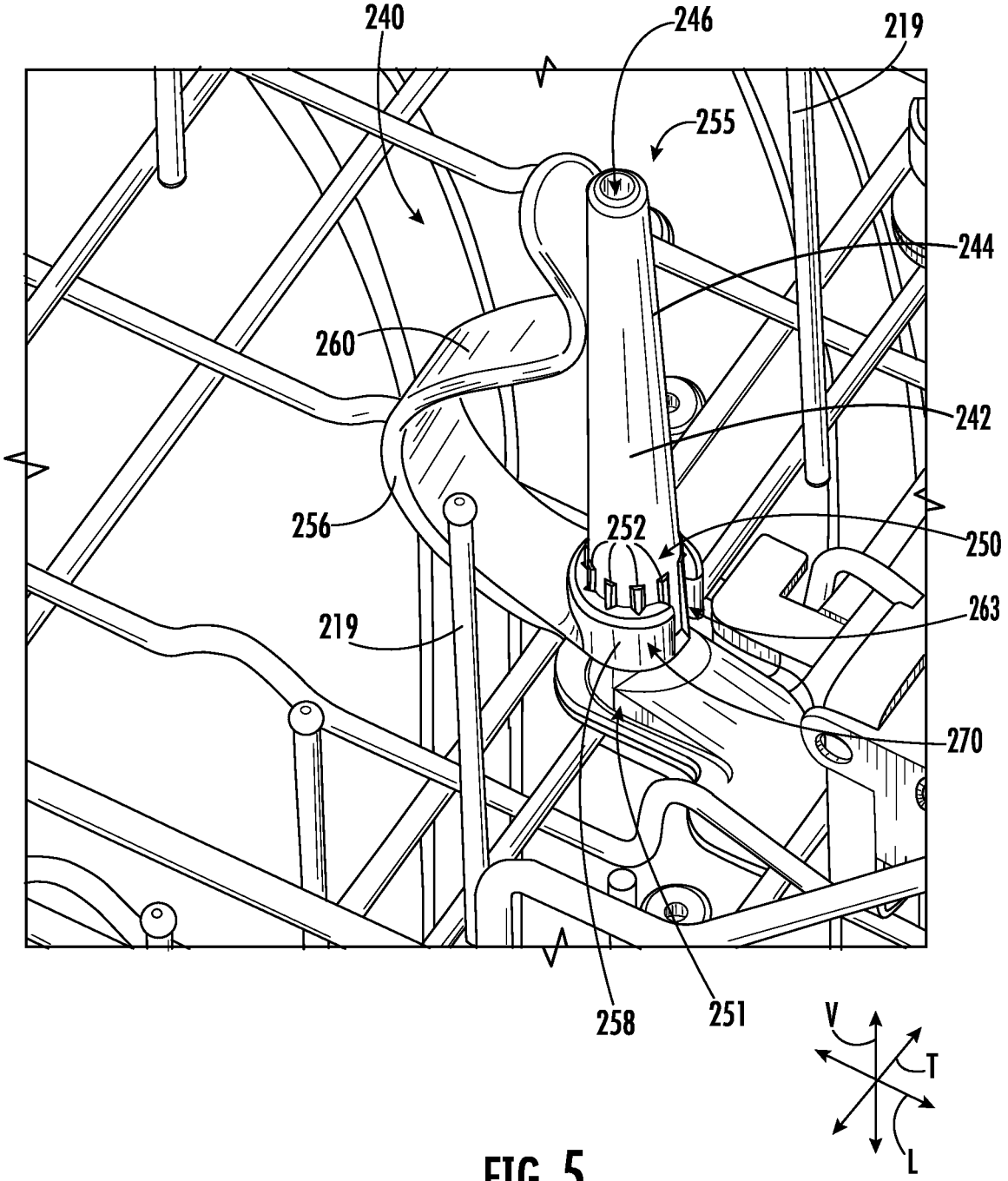
FIG. 5 provides a partial perspective view of a bottle washer assembly according to one or more exemplary aspects of the present subject matter.
Figure 6:
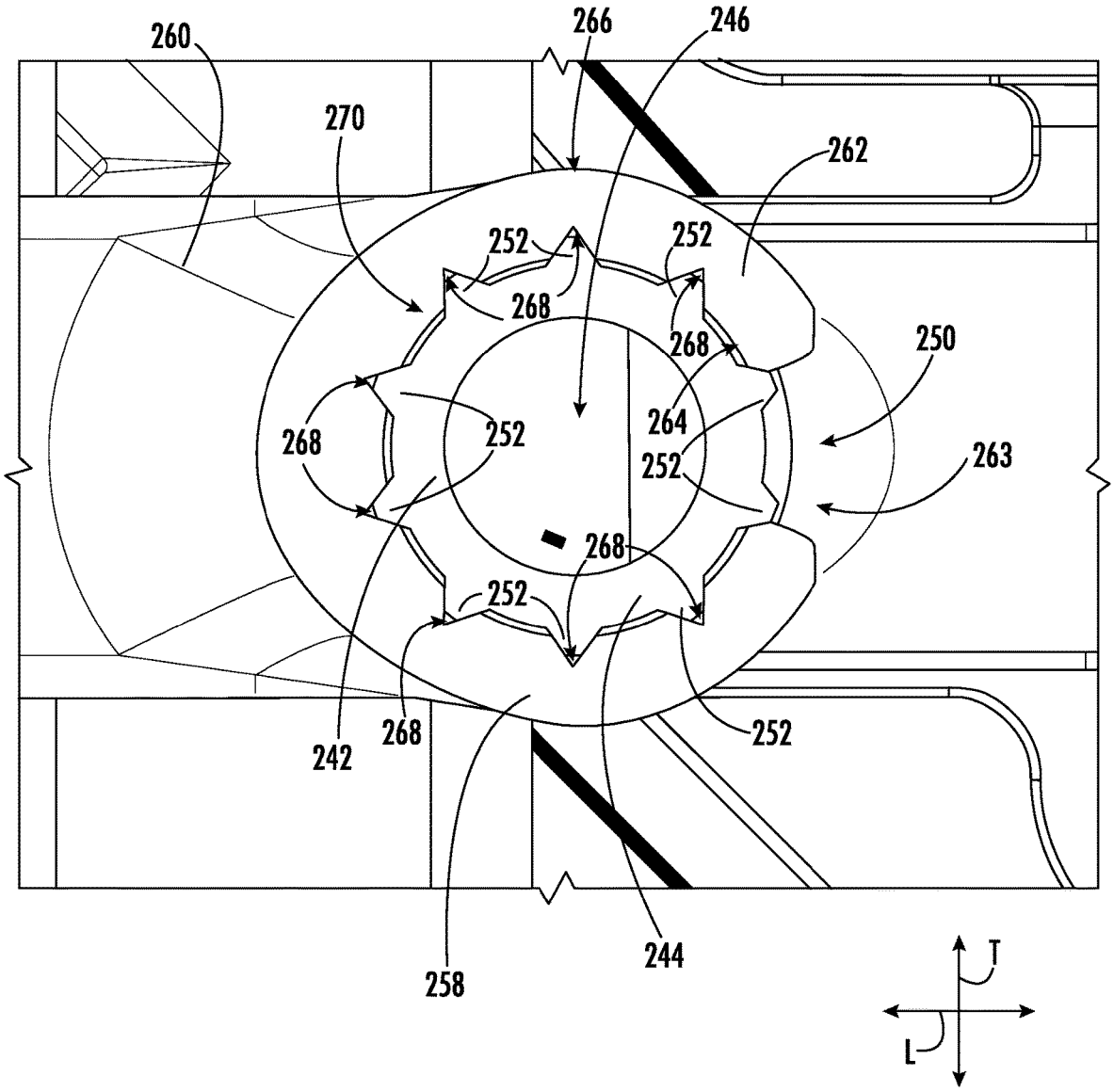
FIG. 6 provides a cross-sectional view of a bottle jet and a clip of a bottle washer assembly according to one or more exemplary embodiments of the present subject matter.

Referring now to FIGS. 3 through 6, a rack assembly 200 and one or more components thereof, for example, a bottle washer assembly 240 are provided. Specifically, FIGS. 3 and 4 illustrate partial perspective views of a rack assembly 200 according to an exemplary embodiment of the present subject matter. FIGS. 5 and 6 illustrate a discrete bottle jet 242 and a discrete clip 256 of the bottle washer assembly 240 according to one or more exemplary embodiments of the present subject matter.

Rack assembly 200 may be used in any suitable dishwasher appliance. As an example, rack assembly 200 may be utilized in dishwasher appliance 100, e.g., as upper rack assembly 130 (FIG. 2) or alternatively as lower rack assembly 132. Rack assembly 200 may generally include features for directing flows of wash fluid into the wash chamber 106, such as generally towards rack assembly 200, as discussed in greater detail below.

As may be seen in FIGS. 3 and 4, rack assembly 200 defines an interior volume 206. In particular, a bottom wall 210, a back wall 216, a front wall 217 and side walls 218 (only one of which is shown) of rack assembly 200 may assist with defining interior volume 206 of rack assembly 200. Thus, interior volume 206 of rack assembly 200 may be defined between bottom wall 210, back wall 216, front wall 217 and side walls 218 of rack assembly 200. Articles for washing, such as cups, bowls, bottles, etc., may be placed or positioned within interior volume 206 of rack assembly 200 such that the articles for washing are supported by rack assembly 200 during operation of dishwasher appliance 100.

Rack assembly 200 can also include a plurality of tines 219, which as shown are fixed tines but alternatively may be rotatable tines, for assisting with supporting articles within interior volume 206 of rack assembly 200. Fixed tines 219 are mounted to bottom wall 210 of rack assembly 200 and extend into interior volume 206 of rack assembly 200, e.g., upwardly along the vertical direction V. In particular, as shown in FIGS. 3 and 4, bottom wall 210 may include a series of lateral members 212 fixed to a series of transverse members 214. Each lateral member of lateral members 212 extends along the lateral direction L. Lateral members 212 are also spaced apart from one another along the transverse direction T. Similarly, each transverse member of transverse members 214 extend along the transverse direction T. Transverse members 214 are also spaced apart from one another along the lateral direction L. Thus, lateral members 212 and transverse members 214 form a lattice structure for containing articles within rack assembly 200. Fixed tines 219 may be mounted or fixed (e.g., welded) to lateral members 212 or transverse members 214 of bottom wall 210 of rack assembly 200 and extend into interior volume 206 of rack assembly 200, e.g., upwardly along the vertical direction V, from bottom wall 210.

Rack assembly 200 further includes a first spray assembly 222 and a second spray assembly 224. First and second spray assemblies 222, 224 are positioned and oriented for directing respective flows of wash fluid into wash chamber 106, such as towards interior volume 206 of rack assembly 200. The flows of wash fluid from first and second spray assemblies 222, 224 can assist with cleaning articles within interior volume 206 of rack assembly 200, as will be understood by those skilled in the art. Thus, rack assembly 200 includes features for, e.g., selectively, directing multiple flows of washing fluid into interior volume 206 of rack assembly 200.

First spray assembly 222 is positioned or oriented for directing a first flow of wash fluid towards or into rack assembly 200. In the exemplary embodiment shown in FIGS. 3 and 4, first spray assembly 222 may be a spray arm, such as mid-level spray assembly 148 of dishwasher appliance 100. Thus, first spray assembly 222 may be a spray arm rotatably mounted to rack assembly 200 at bottom wall 210 of rack assembly 200. In particular, first spray assembly 222 may be positioned below bottom wall 210 of rack assembly 200, e.g., along the vertical direction V, and direct the first flow of wash fluid towards or into rack assembly 200 through bottom wall 210.

Second spray assembly 224 is positioned or oriented for directing a second flow of wash fluid towards or into rack assembly 200. In particular, as shown in FIGS. 3 through 6, second spray assembly 224 is a bottle washer assembly 240. Bottle washer assembly 240 is mounted to rack assembly 200 at bottom wall 210 of rack assembly 200. Bottle washer assembly 240 includes a plurality of bottle jets 242. Articles, and more particular, bottles (such as baby bottles), cups, glasses, etc., may be positioned on or over the plurality of bottle jets 242. The plurality of bottle jets 242 may be mounted to a main conduit 248 of the bottle washer assembly 240 and can extend into interior volume 206 of rack assembly 200, e.g., upwardly along the vertical direction V. In some embodiments, each bottle jet 242 of the plurality of the bottle jets 242 is distributed between fixed tines 219 of bottom wall 210. For example, as shown in FIGS. 3 through 5, each bottle jet 242 of the plurality of bottle jets 242 may be positioned between respective pairs of fixed tines 219.

To provide wash fluid to first spray assembly 222 and second spray assembly 224, rack assembly 200 includes a supply conduit 220. Supply conduit 220 is configured for receiving wash fluid during operation of an associated dishwasher appliance 100 and directing such wash fluid to first spray assembly 222 or second spray assembly 224. For example, supply conduit 220 may be in fluid communication with the fluid circulation assembly of dishwasher appliance 100 when rack assembly 200 is in a closed position. Thus, the fluid circulation assembly of dishwasher appliance 100, e.g. a pump of the fluid circulation assembly, may direct wash fluid from tub sump portion 142 of tub 104 to supply conduit 220 during operation of dishwasher appliance 100.

In some embodiments, supply conduit 220 includes a first segment 230 that extends to or towards first spray assembly 222 and a second segment 232 that extends to or towards second spray assembly 224. First segment 230 of supply conduit 220 directs wash fluid therethrough to first spray assembly 222, e.g., during operation of dishwasher appliance 100. Second segment 232 of supply conduit 220 is configured for directing wash fluid to second spray assembly 224, e.g., during operation of dishwasher appliance 100. (It should be noted that second segment 232 is shown in an exploded position in FIG. 3 for illustrative purposes only).

Each bottle jet 242 may include a spray conduit 244 defining a spray passage 246 therewithin. The spray passage 246 may be in selective fluid communication with a main passage 247 defined by the main conduit 248. The spray passage 246 may selectively flow wash fluid from the main passage 247 to an article that may be positioned on or over the spray conduit 244 of the respective bottle jet 242. Additionally, the spray conduit 244 may include a spline portion 250. The spline portion 250 may be positioned at or adjacent to a proximal end 251 of the spray conduit 244. In some embodiments, the spline portion 250 includes one or more teeth 252 extended therefrom. For instance, as illustrated in FIGS. 5 and 6, the one or more teeth 252 may include or be provided as a plurality of teeth. Each tooth of the one or more teeth 252 may be spaced apart circumferentially around the spline portion 250. In some embodiments, each tooth of the one or more teeth 252 defines a predetermined shape. As will be described in more detail below, the predetermined shape of each tooth of the one or more teeth 252 may, at least in part, define a predetermined rotational force for a selectively rotatable spline joint 270. For example, as shown in FIGS. 5 and 6, each tooth of the one or more teeth 252 may define a trapezoidal shaped cross-section. As will be appreciated in more detail below, the shape of each tooth of the one or more teeth 252 may correspond to a shape of a complementary groove. In this regard, each tooth of the one or more teeth 252 may be received within a corresponding groove of one or more grooves 268 (e.g., described in more detail below).

As briefly mentioned above, each bottle jet 242 of the plurality of bottle jets 242 may assist with supporting articles within interior volume 206 of rack assembly 200. In addition, each bottle jet 242 may be configured to emit a stream of wash fluid during operation of bottle washer assembly 240. The stream of wash fluid may be directed against or onto an article positioned over or on each respective one of bottle jets 242. In such a manner, bottles and other containers may be washed or cleaned during operation of dishwasher appliance 100. In some embodiments, the bottle jets 242 include a cap 254. Each cap 254 may be mounted at or adjacent to a distal end 255 of the spray conduit 244. The cap 254 may further define a plurality of outlet apertures through which wash fluid may be exhausted from the bottle jet 242 into the wash chamber, and more particularly, against or onto an article positioned over the respective bottle jet 242. Accordingly, wash fluid may flow from the distal end 255 of the spray conduit 244 into the cap 254, and from the cap 254 into the wash chamber through the outlet apertures.

Bottle washer assembly 240 may also include a plurality of clips 256. Each clip of the plurality of clips 256 may include a spline plate 258 and a resilient arm 260 extended upward from the spline plate 258. The spline plate 258 may include a first body 262 partially disposed about the spline portion 250 of the spray conduit 244. As should be appreciated, the shape defined by the first body 262 may generally be complementary to the shape defined by the spline portion 250. For example, as shown in FIGS. 5 and 6, the spline portion 250 may define a circular shape, e.g., the spline portion 250 may define a circular cross-section, and the first body 262 may define a crescent shape, e.g., the first body 262 may define a crescent shaped cross-section.

However, it should be appreciated that in some other exemplary embodiments, the spline portion 250, and thus, the first body 262 may define any suitable shape. For example, in some other exemplary embodiment, the spline portion 250 may define a square shape or a triangular shape, e.g., the spline portion 250 may define a square shaped cross-section or a triangular shaped cross-section. In some such embodiments, the first body 262 may define a complementary square shape or a triangular. Additionally, in some such embodiments, the first body 262 may define an expansion gap 263 as described in more detail below.

Moreover, the first body 262 may define the expansion gap 263 and may include an inner surface 264 and an outer surface 266. Generally, the first body 262 may be sized and shaped such that the inner surface 264 of the first body 262 may fit around the spline portion 250 of the spray conduit 244. For instance, first body 262, and more particularly, the expansion gap 263 may be expanded to fit around the spline portion 250. The inner surface 264 of the first body 262 may define a one or more grooves 268 for receiving the one or more teeth 252. The one or more grooves 268 may be complementary to the one or more teeth 252. That is, the shape of each groove of the one or more grooves 268 may be complementary to the shape of each tooth of the one or more teeth 252. In this regard, each groove of the one or more grooves 268 may receive a corresponding tooth of the one or more teeth 252. As illustrated in FIGS. 5 and 6, the one or more grooves 268 may be a plurality of grooves. For example, each groove of the plurality of grooves may define a triangular shaped cross section. The triangular shape of each groove may be configured to receive the trapezoidal shape of each tooth.

Each clip of the plurality of clips 256, and more particularly, each resilient arm 260 of the plurality of clips 256 may engage articles disposed on or over bottle jets 242 to hinder or prevent such articles from moving during operation of bottle washer assembly 240. Thus, as an example, when a stream of fluid from one of bottle jets 242 impacts a bottle disposed over the one of bottle jets 242, the resilient arm 260 of an associated clips 256 may hinder or prevent the bottle from being ejected off the respective bottle jets 242 by the stream of fluid.

According to exemplary embodiments of the present subject matter, the one or more grooves 268 defined within the spline plate 258 and the one or more teeth 252 positioned around the spline portion 250 may advantageously form a selectively rotatable spline joint 270 to selectively lock the clip 256 relative to the bottle jet 242 in one or more predetermined positions. Additionally, the selectively rotatable spline joint 270 may mitigate or reduce unintentional removal of the clip 256 relative to the spray conduit 244 before, during, or after operation (e.g., a wash cycle) of the dishwasher appliance 100.

The selectively rotatable spline joint 270 may allow a user to rotate or "snap" the spline plate 258, and thus the clip 256, between one or more predetermined positions. For instance, when a user applies a predetermined rotational force to the clip 256 (e.g., a force in a clockwise or counterclockwise direction relative to the spline portion 250), the spline plate 258 may rotate around the spline portion 250 of the spray conduit 244. Specifically, when the predetermined rotational force is applied to the clip 256, each tooth of the one or more teeth 252 positioned within a groove of the one or more grooves 268 may be freed from (e.g., "snapped" out of) the corresponding groove. Furthermore, when the predetermined rotational force is applied to the clip 256, the expansion gap 263 may expand to allow the one or more teeth 252 to be freed from the one or more grooves 268. After being freed, the one or more teeth 252 may be repositioned in an adjacent groove of the one or more grooves 268. In some embodiments, the shape of the one or more grooves 268 and the shape of the one or more teeth 252 may define the predetermined rotational force. For example, the trapezoidal shape of each tooth of the one or more teeth 252 and the triangular shape of each groove of the one or more grooves 268 may define the predetermined rotational force. That is the predetermined rotational force may correspond to the force that it may take to rotate the trapezoidal shaped tooth out of the triangular shaped groove.

In some embodiments, the number of predetermined positions corresponds to the number of teeth on the spline portion 250. For example, as illustrated in FIG. 6, the spline portion 250 may include ten teeth 252. Thus, for the exemplary embodiment of FIG. 6, there may be ten predetermined positions for the clip 256. In other words, the clip 256 may be rotated or "snapped" into ten unique positions relative to the spline portion 250.

One of ordinary skill in the art would recognize that the number of predetermined positions illustrated in FIG. 6 is provided by way of example only. For instance, in additional or alternative exemplary embodiments, there may be any suitable number of predetermined positions. For example, in additional or alternative exemplary embodiments there may be two or more predetermined, such as four or more predetermined positions, such twelve or more predetermined positions. Moreover, in additional or alternative embodiments, the shape of the spline portion 250 may define the one or more predetermined positions. For example, in additional or alternative embodiments, the spline portion 250 may be rectangular or triangular shaped. In such embodiments, each vertex of the spline portion 250 may define a tooth of the one or more teeth 252. Thus, in such embodiments, each vertex of the spline portion 250 may define a predetermined position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bottle washer assembly for a dishwasher appliance, the bottle washer assembly comprising:

a main conduit defining a main passage for flowing wash fluid therethrough; and a bottle jet comprising a spray conduit extending between a proximal end and a distal end, the spray conduit defining a passage in selective fluid communication with the main passage, the spray conduit comprising a spline portion positioned at the proximal end, the spline portion comprising one or more teeth extended therefrom; and a clip defining one or more grooves for receiving the one or more teeth.

2. The bottle washer assembly of claim 1, wherein the clip comprises a spline plate, wherein the one or more grooves are defined by the spline plate, and wherein the spline plate is slidably attached to the spline portion to form a selectively rotatable spline joint.

3. The bottle washer assembly of claim 2, wherein the spline plate comprises a first body partially disposed about the spline portion, wherein the first body comprises an inner surface and an outer surface, and wherein the one or more grooves are defined at the inner surface of the spline plate.

4. The bottle washer assembly of claim 3, wherein the selectively rotatable spline joint comprises one or more predetermined positions, wherein the one or more predetermined positions are defined by the one or more teeth.

5. The bottle washer assembly of claim 4, wherein the first body defines an expansion gap, wherein in each predetermined position the one or more teeth are in mated engagement with the one or more grooves to selectively lock the clip in place relative to the spray conduit, and wherein in between each predetermined position the expansion gap is expanded to free the one or more teeth from mated engaged with the one or more grooves.

6. The bottle washer assembly of claim 2, wherein the clip further comprises a resilient arm extending upward from the spline plate.

7. The bottle washer assembly of claim 1, wherein the one or more teeth are a plurality of teeth spaced circumferentially apart around the spline portion.

8. The bottle washer assembly of claim 7, wherein one or more grooves are a plurality of grooves, and wherein the plurality of grooves are complementary to the plurality of teeth.

9. The bottle washer assembly of claim 8, wherein each tooth of the plurality of teeth defines a trapezoidal shaped cross section, and wherein each groove of the plurality of grooves defines a complementary triangular shaped cross section.

10. The bottle washer assembly of claim 1, wherein the bottle jet is a plurality of bottle jets, wherein the clip is a plurality of clips, and wherein each clip of the plurality of clips is attached to a respective bottle jet of the plurality of bottle jets.

11. A dishwasher appliance comprising:

a tub defining a wash chamber;

a rack assembly disposed within the wash chamber of the tub;

a first spray assembly positioned adjacent the rack assembly; and a second spray assembly positioned adjacent the rack assembly, wherein the second spray assembly is a bottle washer assembly, the bottle washer assembly comprising:

a main conduit defining a main passage for flowing wash fluid therethrough; and a bottle jet comprising a spray conduit extending between a proximal end and a distal end, the spray conduit defining a passage in selective fluid communication with the main passage, the spray conduit comprising a spline portion positioned at the proximal end, the spline portion comprising one or more teeth extended therefrom; and a clip defining one or more grooves for receiving the one or more teeth.

12. The dishwasher appliance of claim 11, wherein the clip comprises a spline plate, wherein the one or more grooves are defined by the spline plate, and wherein the spline plate is slidably attached to the spline portion to form a selectively rotatable spline joint.

13. The dishwasher appliance of claim 12, wherein the spline plate comprises a first body partially disposed about the spline portion, wherein the first body comprises an inner surface and an outer surface, and wherein the one or more grooves are defined at the inner surface of the spline plate.

14. The dishwasher appliance of claim 13, wherein the selectively rotatable spline joint comprises one or more predetermined positions, and wherein the one or more predetermined positions are defined by the one or more teeth.

15. The dishwasher appliance of claim 14, wherein the first body defines an expansion gap, wherein in each predetermined position the one or more teeth are in mated engagement with the one or more grooves to selectively lock the clip in place relative to the spray conduit, and wherein in between each predetermined position the expansion gap is expanded to free the one or more teeth from mated engaged with the one or more grooves.

16. The dishwasher appliance of claim 12, wherein the clip further comprises a resilient arm extending upward from the spline plate.

17. The dishwasher appliance of claim 11, wherein one or more teeth are a plurality of teeth spaced circumferentially apart around the spline portion.

18. The dishwasher appliance of claim 17, wherein the one or more grooves are a plurality of grooves, and wherein the plurality of grooves are complementary to the plurality of teeth.

19. The dishwasher appliance of claim 18, wherein each tooth of the plurality of teeth defines a trapezoidal shaped cross section, and wherein each groove of the plurality of grooves defines a complementary triangular shaped cross section.

20. The dishwasher appliance of claim 11, wherein the bottle jet is a plurality of bottle jets, wherein the clip is a plurality of clips, and wherein each clip of the plurality of clips is attached to a respective bottle jet of the plurality of bottle jets.

* * * * *